US006842910B1

(12) United States Patent
Martinez

(10) Patent No.: US 6,842,910 B1
(45) Date of Patent: Jan. 18, 2005

(54) CONVERTIBLE CAPE

(76) Inventor: Christina Martinez, 20382 Damietta Dr., Walnut, CA (US) 91789

( * ) Notice: Subject to any disclaimer, the term of this patent is extended or adjusted under 35 U.S.C. 154(b) by 0 days.

(21) Appl. No.: 10/351,002

(22) Filed: Jan. 25, 2003

(51) Int. Cl.[7] ..... A41D 13/00; A42B 1/04
(52) U.S. Cl. ..... 2/50; 2/174
(58) Field of Search ..... 2/50, 174, 49.1, 2/49.2, 46, 48, 49.4, 49.5, 51, 52, 88, 171, 172, 181, 202, 207, 209.11; 132/333, 270, 212; 4/521

(56) References Cited

U.S. PATENT DOCUMENTS 4,133,052 A * 1/1979 Hodgman et al. ..... 2/174
4,605,017 A * 8/1986 Thompson et al. ..... 132/333
4,611,354 A * 9/1986 Jones ..... 2/174
4,646,364 A * 3/1987 O'Larey ..... 2/50
4,914,754 A * 4/1990 Ruth ..... 2/174
5,079,777 A * 1/1992 Fowler et al. ..... 2/50
5,146,629 A * 9/1992 Barnes ..... 2/174
5,551,088 A * 9/1996 Stepp ..... 2/174
5,890,229 A * 4/1999 Esposito ..... 2/174
5,950,636 A * 9/1999 Hickey ..... 132/200
6,119,268 A * 9/2000 McCauslin ..... 2/50
6,496,985 B1 * 12/2002 Faldet ..... 2/50
6,519,777 B1 * 2/2003 Speelman ..... 2/174

* cited by examiner

*Primary Examiner*—Amy B. Vanatta
(74) *Attorney, Agent, or Firm*—Michael I. Kroll

(57) ABSTRACT

The present invention 10 discloses a convertible cape having a moisture impermeable body with straps 30 having at least one fastening member 32 positioned on at least one strap 30 distal end. The present invention 10 can be converted from a collapsed or cape-like form 22 to an expanded or bag-like form 16 having a cavity 38 therein. The moisture impermeable body is comprised of two planar sheets 58, 60 of malleable moisture impermeable material having spaced apart side walls 56 positioned between the sheets and connected thereto. The opposing moisture impermeable sheets have spaced apart side walls 56 which are connected at both distal ends thereby forming a cavity 38 having an open end 42 and straps 30. The open end 42 is sealed during processing having a means for expanding the parallel coplanar malleable moisture impermeable materials such as a tear strip or perforation 34 whereby the enclosure can be selectively expanded by removal of the tear strip or separation along the perforation 34.

11 Claims, 12 Drawing Sheets

CONVERTIBLE CAPE

BACKGROUND OF THE INVENTION

Field of the Invention

The present invention relates generally to capes and, more specifically, to a disposable convertible cape having a moisture impermeable body and straps having at least one fastening member positioned on at least one strap distal end. The moisture impermeable body is comprised of two planar sheets of malleable moisture impermeable material having spaced apart side walls positioned between the sheets and connected thereto. The opposing moisture impermeable sheets having spaced apart side walls of identical material are further connected at both distal ends thereby forming an enclosure having an open end and straps. The open end is sealed during processing having a means for expanding the parallel coplanar malleable moisture impermeable materials such as a tear strip or perforation whereby the enclosure can be selectively expanded by removal of the tear strip or separation along the perforations.

The at least one fastening member provides for the selective mating of one strap to the other. The straps can be linear or curved but must be of sufficient length whereby they can be selective fastened using the fastening element after passing around the human neck.

While there are other cape devices that may be suitable for the purposes for which they were designed, they would not be as suitable for the purposes of the present invention, as hereinafter described.

Therefore it is felt that a need exists for a convertible cape having have a collapsed form that keeps the opposing walls together whereby the compressed form has a sheet-like quality.

Furthermore, the convertible cape has means for expanding the sheet-like form into a bag-like form having means for releasing the opposing sides such as a tear strip or perforation. Also, the convertible cape has a pair of straps with at least one fastening element positioned on the distal end of one of the straps.

SUMMARY OF THE PRESENT INVENTION

The present invention discloses a convertible cape having a moisture impermeable body with straps having at least one fastening member positioned on at least one strap distal end. The present invention can be converted from a collapsed form to a bag-like form having a cavity therein. The moisture impermeable body is comprised of two planar sheets of malleable moisture impermeable material having spaced apart side walls positioned between the sheets and connected thereto. The opposing moisture impermeable sheets have spaced apart side walls which are connected at both distal ends thereby forming a cavity having an open end and straps. The open end is sealed during processing having a means for expanding the parallel coplanar malleable moisture impermeable materials such as a tear strip or perforation whereby the enclosure can be selectively expanded by removal of the tear strip or separation along the perforation.

A primary object of the present invention is to provide a convertible cape that can be used in the hair care treatment industry.

Another object of the present invention is to provide a convertible cape manufactured from a pliable moisture impervious material.

Yet another object of the present invention is to provide a convertible cape having a sheet-like portion and straps.

Still yet another object of the present invention is to provide a convertible cape having straps with at least one fastener positioned on the distal end of a strap.

Another object of the present invention is to provide a convertible cape that can be dispensed in a sheet-like form.

Yet another object of the present invention is to provide a convertible cape that can be dispensed in a roll form having a perforation for separating one bag from another.

Still yet another object of the present invention is to provide a convertible cape that can be expanded from a sheet-like form into a bag-like form.

Another object of the present invention is to provide a convertible cape having opposing sheet-like layers having a tear strip or perforation whereby the sheet-like form can be expanded to a bag-like form.

Additional objects of the present invention will appear as the description proceeds.

The present invention overcomes the shortcomings of the prior art by providing a convertible cape having a sheet-like form in a compressed state and a bag-like form in an expanded state. The convertible cape has straps with at least one fastener positioned on a strap distal end whereby the straps can be mated in a secure fashion. The convertible cape has a tear strip or perforation whereby the cape can be expanded into a bag-like form.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
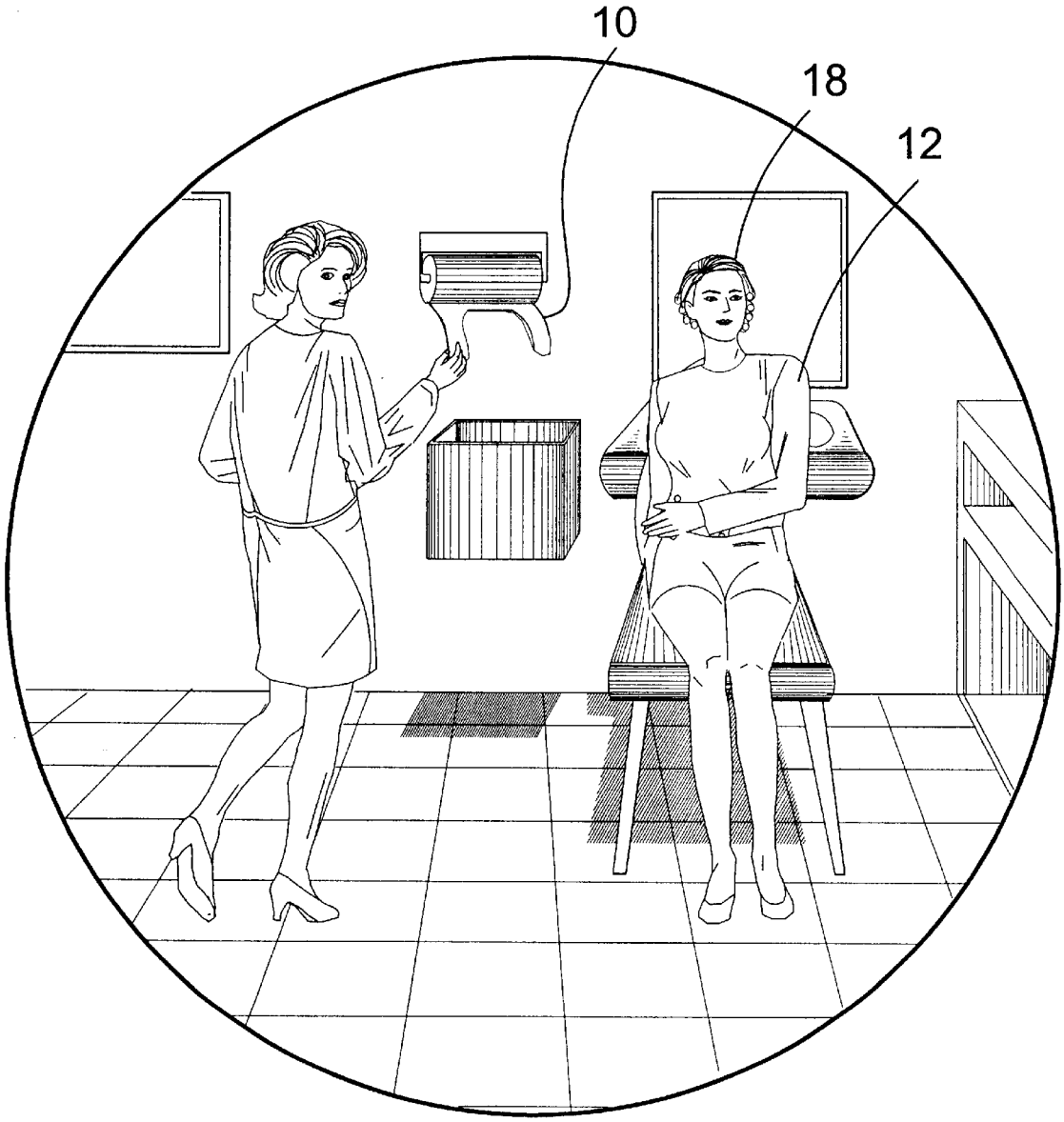
FIG. 1 is an illustrative view of the present invention.

With regard to reference numerals used, the following numbering is used throughout the drawings.

10 present invention
12 user
14 dispenser
16 bag
18 head
20 hair dryer
22 cape
23 cape extension
24 sink
26 fluid
28 drain
30 straps
32 double sided tape
34 perforation
36 bonded material
38 cavity
40 pleat
42 opening
44 collar material
46 box dispenser
48 box dispenser aperture
50 roll of the present invention
52 end perforation
54 neck opening
56 side walls
58 front layer
60 rear layer

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For a definition of the complete scope of the invention, the reader is directed to the appended claims.

Turning to FIG. 1, shown therein is an illustrative view of the present invention 10. The collapsed form or cape-like form of the present invention is a multi-sheet material that converts into an expanded form or bag-like structure by separating the multi-layers along a provided perforation (not shown, see FIG. 9). The open end of the bag-like form is initially sealed during processing having a means for expanding the opposing side such as a tear strip or perforation whereby the collapsed form is converted to a bag-like structure which can be opened by removal of the tear strip or separation along the perforation. During a loop perm process, the bag is placed over the hair and head 18 of the person 12 receiving the process, to prevent the chemicals used in the process from drying. When the bag is removed it is placed and secured over the back of the neck, extending from the back of the neck into the basin of the sink, thus, liquids are intercepted and directed by the sheet material into the sink.

Figure 2:
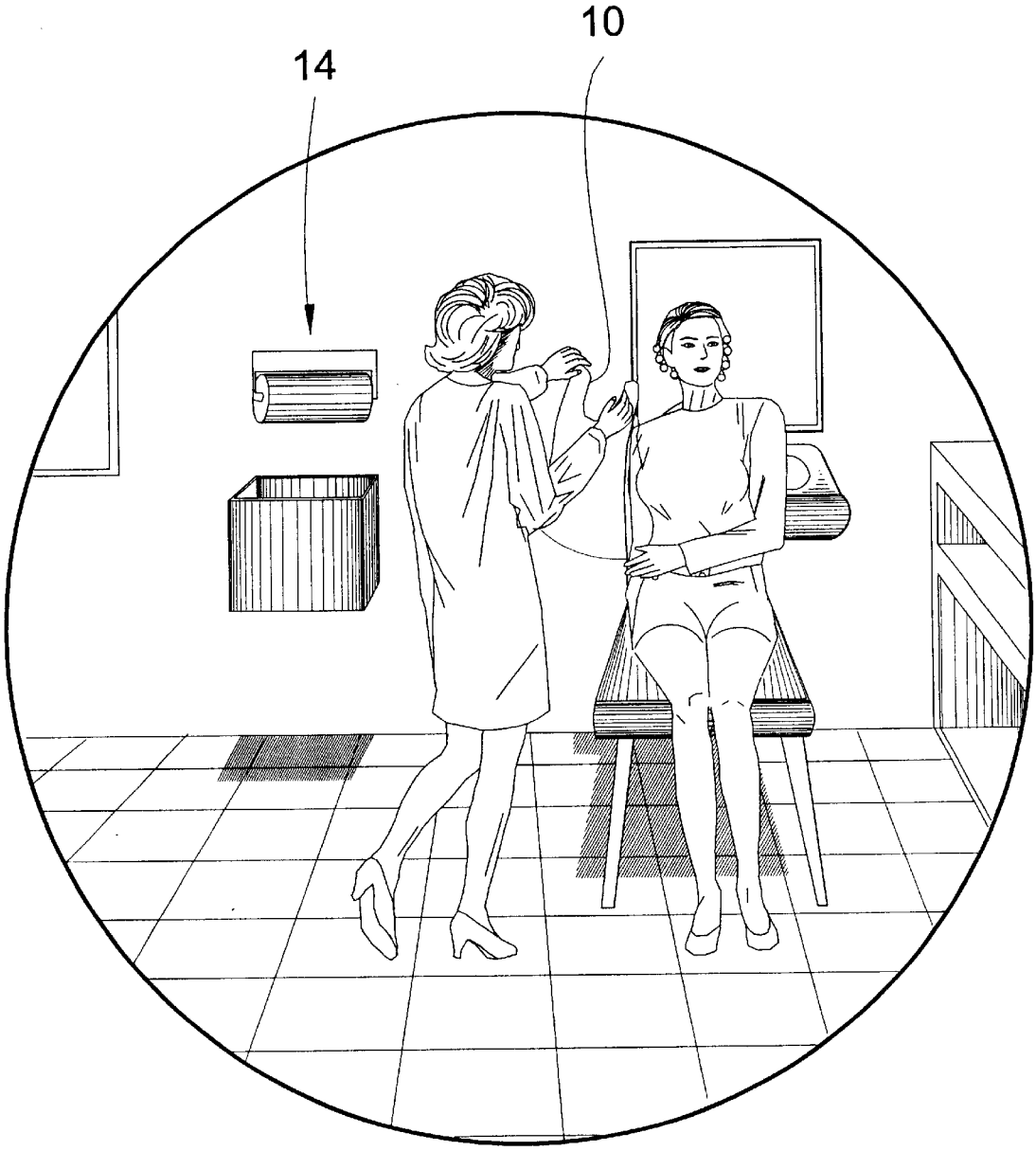
FIG. 2 is an illustrative view of the present invention.

Turning to FIG. 2, shown therein is an illustrative view of the present invention 10. The disposable convertible cape of the present invention 10 is composed of a pliable moisture impermeable material , e.g., plastic, having spaced apart side walls and a closed end when expanded. Prior to use the bag-like structure is flat and can be dispensed from a dispenser 14 on a roll having perforations for separating a single bag from the roll. If the convertible cape is to be expanded into the bag-like structure a tear strip or perforation is provided to access the cavity between the layers.

Figure 3:
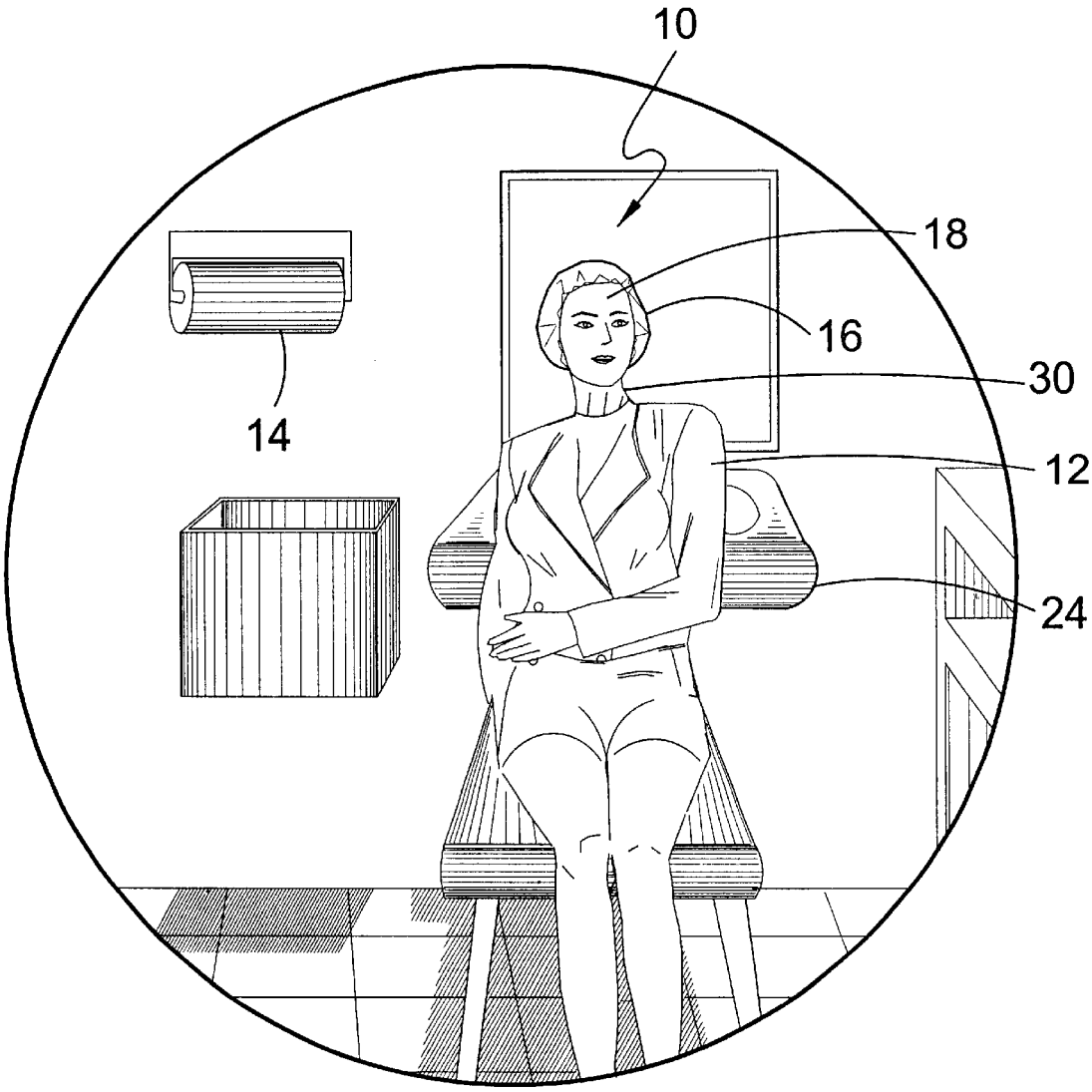
FIG. 3 is an illustrative view of the present invention in use.

Turning to FIG. 3, shown herein is an illustrative view of the present invention 10 in use as a bag-like structure 16 in the expanded form which has spaced apart side walls and a closed end in this expanded form whereby the bag-like structure 16 can be placed over the head 18 to encompass the hair that has been treated with a hair care product to prevent the product from drying out during treatment. The straps 30 of the bag 16 can be used to hold the positioning of the bag over the head much like chin straps. After treatment the bag 16 is removed and positioned around the back of the neck of the person receiving the treatment and used in a cape-like form wherein the sheet-like material projects over the back of the user 12 while the straps 30 are extended around the neck and fixedly attached to one another by means of a fastener in the front. The sheet material will prevent any fluids from dripping down the back of the user 12 while the hair care product is removed by washing and will direct all fluids into the sink 24. A dispenser 14 is also shown.

Figure 4:
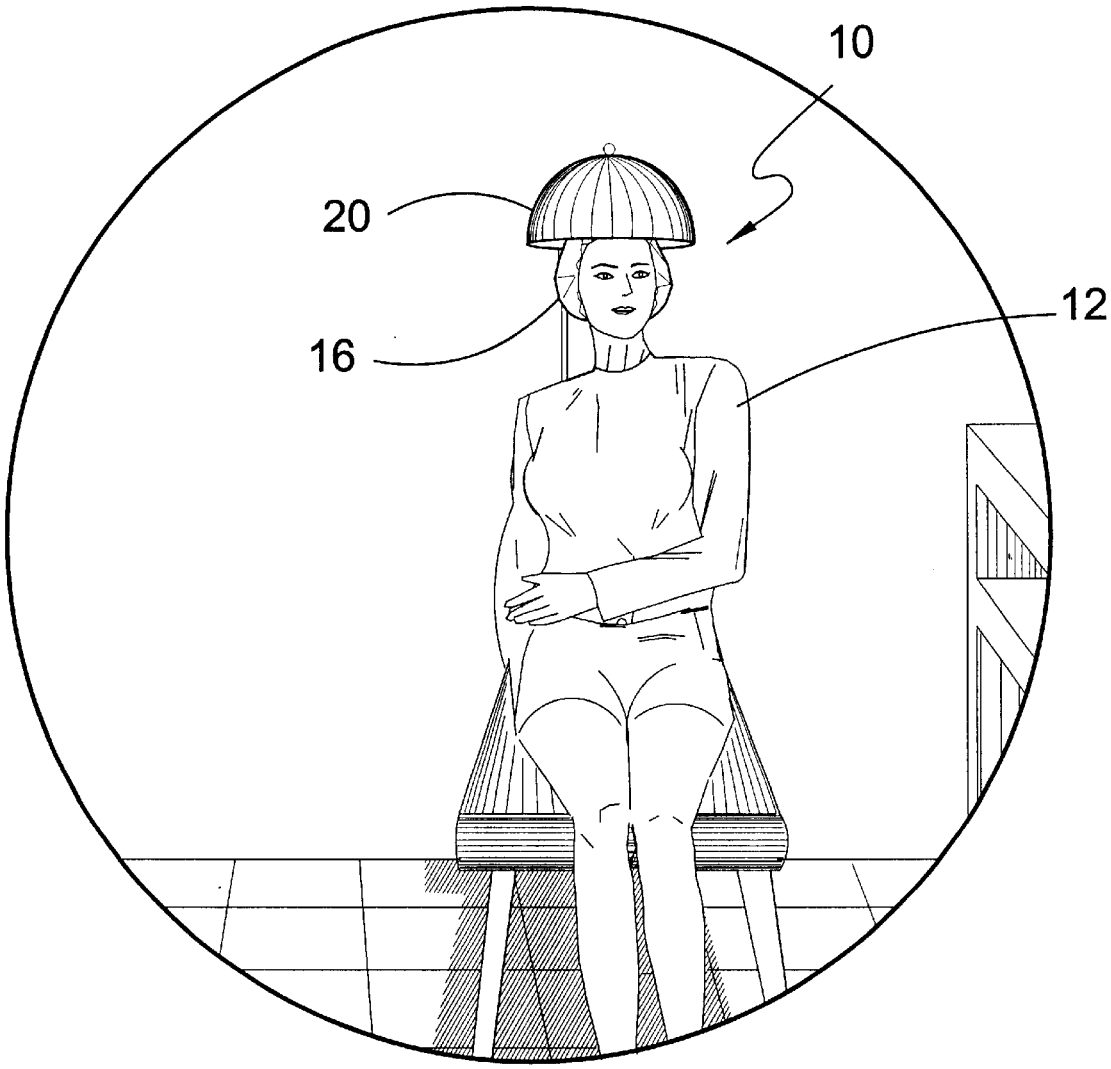
FIG. 4 is an illustrative view of the present invention in use.

Turning to FIG. 4, shown therein is an illustrative view of the present invention 10 in use. Shown is the convertible cape expanded into a bag-like form 16 encompassing the hair of a person 12 receiving hair care treatment in the hair dryer 20. The bag 16 being a pliable moisture impervious material will prevent the hair care product from drying out during the heat treatment process that is used to activate the hair care product. Once the heat treatment process is concluded the convertible cape is removed and repositioned with the sheet material extending down the back of the user with the straps positioned along the neck and secured in the front through use of at least one fastener positioned on a distal end of one of the straps. The straps and sheet material will prevent any fluids from contacting the clothing or dripping down the back of the user.

Figure 5:
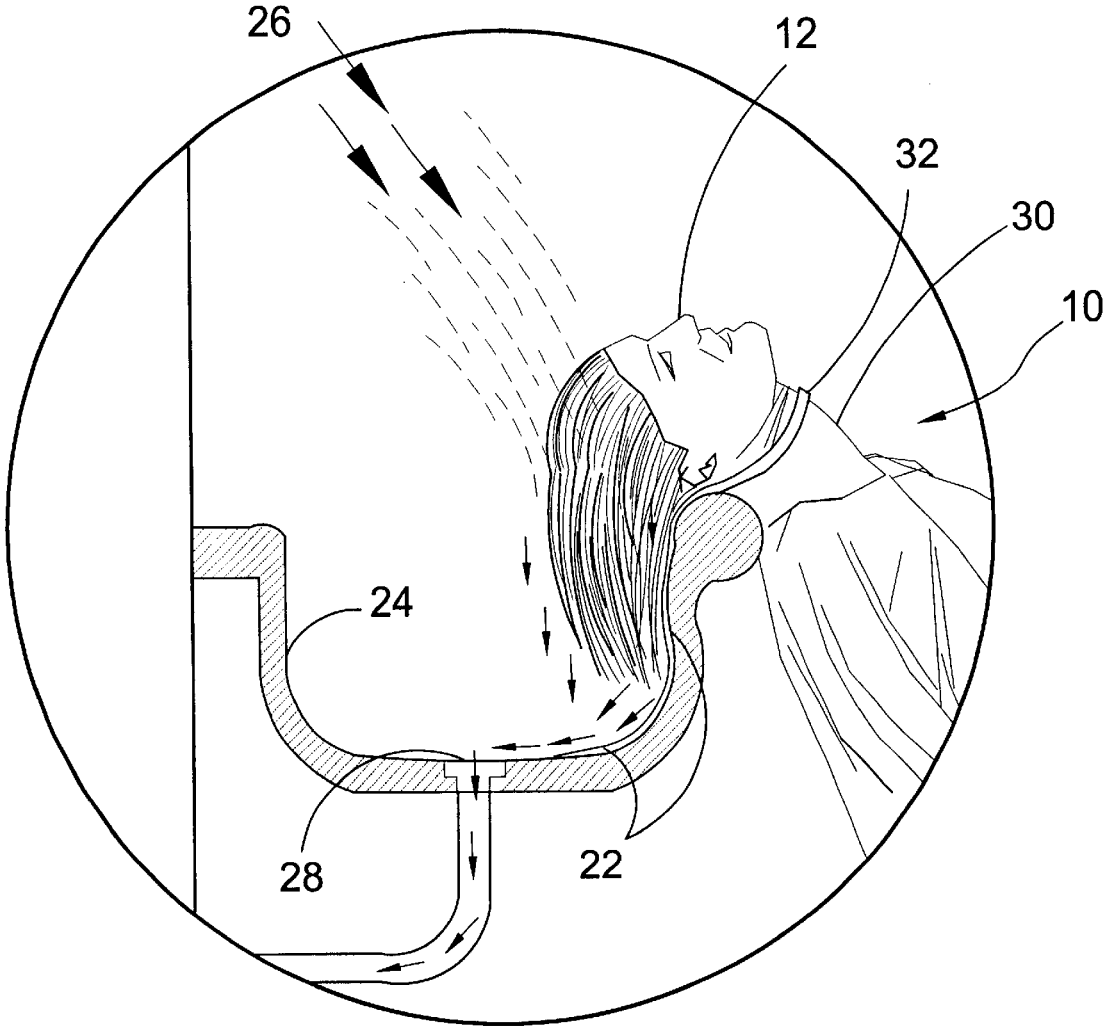
FIG. 5 is a side view of the present invention in use.

Turning to FIG. 5, shown therein is a side view of the present invention 10 in use in the cape-like 22 form. Illustrated is a user 12 during a hair care treatment having the convertible cape having the sheet material extending from the neck of the user into a sink 24 with drain 28. The straps 30 extend to the front and are mated one to another by means of a fastener, e.g., double-sided tape 32. The cape 22 will prevent fluids 26 being applied to the hair from contacting the clothes or dripping down the user's back. The convertible cape can be used from the dispenser in the flat form during some hair care treatments such as washing. The bag-like function is used to encompass the hair to prevent hair care products from drying in the hair.

Figure 6:
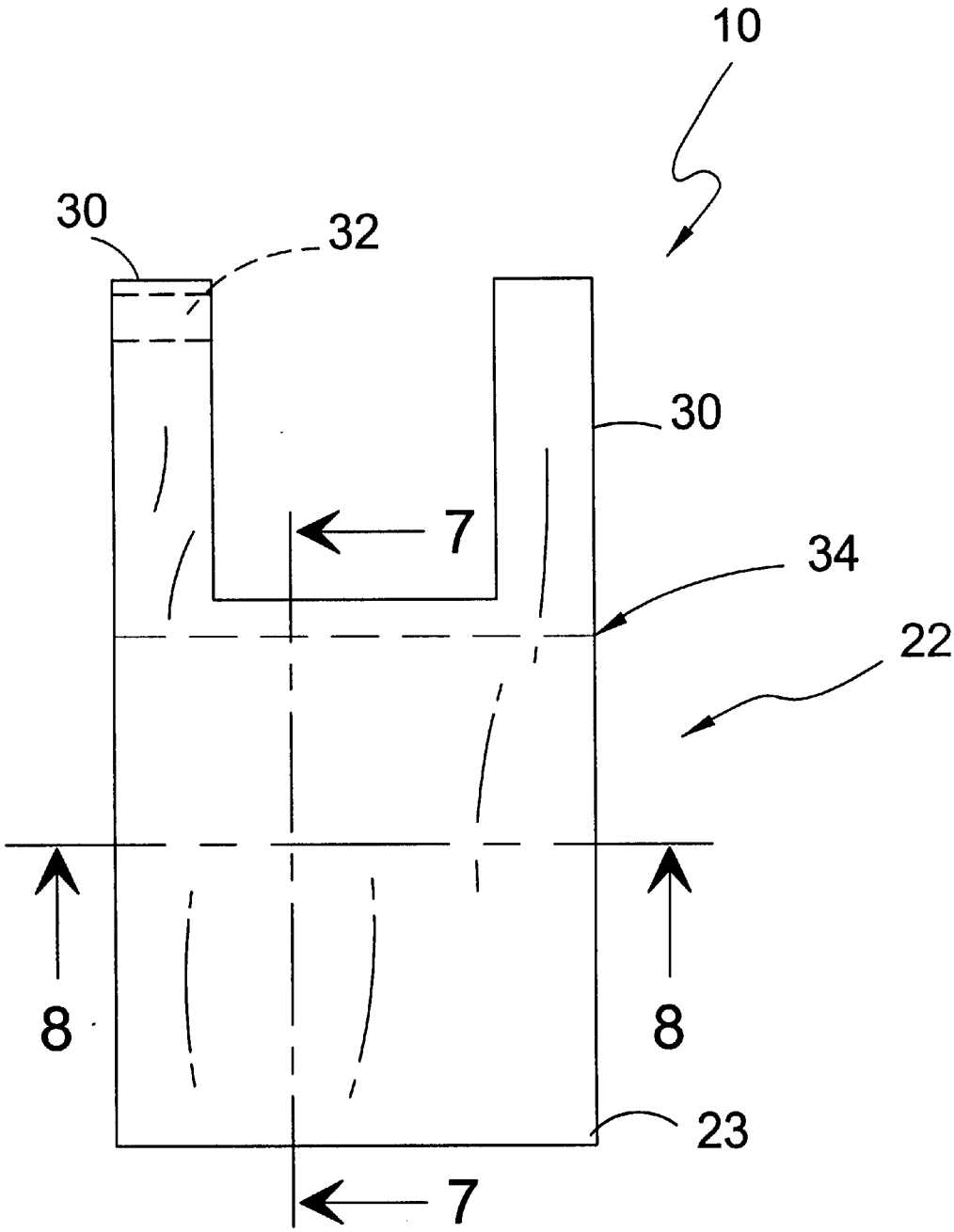
FIG. 6 is a front view of the present invention in a collapsed form.

Turning to FIG. 6, shown therein is a front view of the present invention 10 in a flat, collapsed or cape form. Shown is the convertible cape 22 having a downwardly extending cape extension 23 in a sheet-like form having a perforation 34, e.g., an aligned series of discrete perforate openings, for use when expanding from the cape form into the bag-like form. The convertible cape 22 can be used in the collapsed form as shown here or expanded into a bag depending on the hair care treatment intended. The straps 30 have at least one distal end with a fastening element, e.g., double-sided tape 32, attached thereto whereby the straps 30 can be mated to form a fastening element for securing the sheet material around a user's neck.

Figure 7:
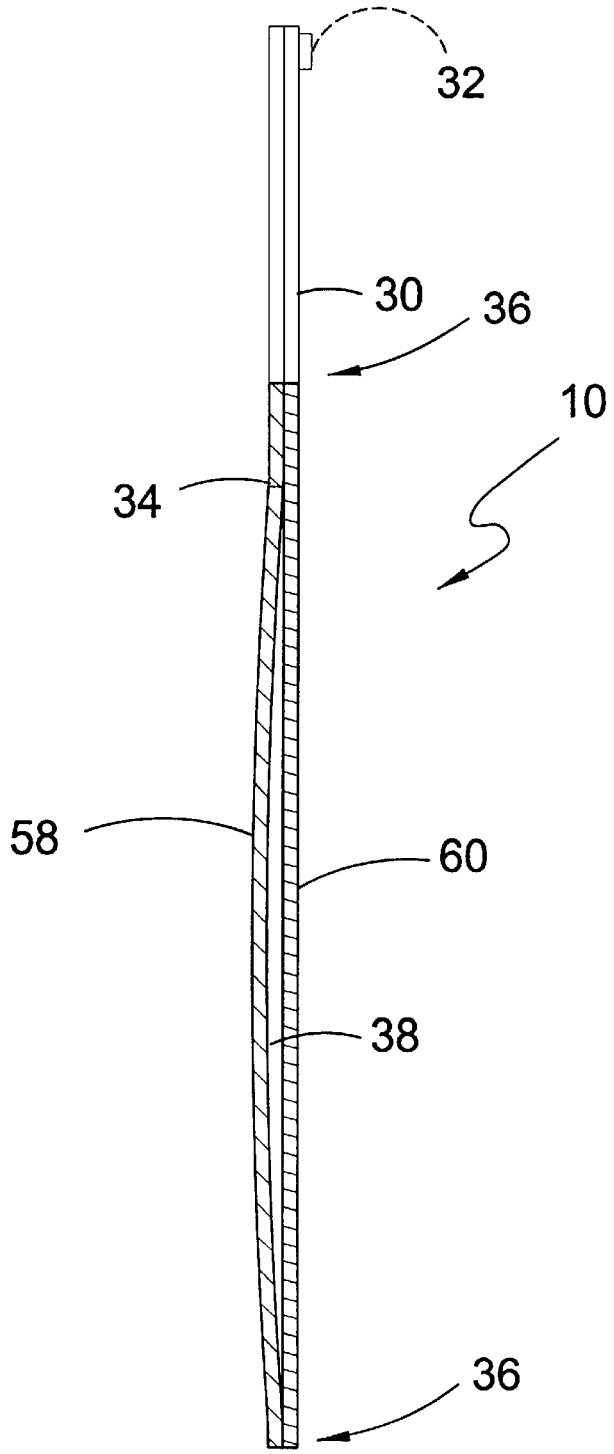
FIG. 7 is a cross sectional view of the present invention.

Turning to FIG. 7, shown therein is a cross sectional view of the present invention 10. Shown is a cross sectional view taken from FIG. 6 as indicated showing the multi-layers of the convertible cape having a length of bonded material 36, e.g., a heated bond, at each edge of each distal end, the straps and the neck opening. Spaced away downwardly from the bonding, but close enough to the bonding to maximize the length and size of cavity 38, is a perforation 34 in the top or front layer 58 whereby separation of the layers at the perforation 34 provides access to the cavity 38 of the bag-like area between the front 58 and rear 60 layers of the convertible cape. Also shown is the at least one fastening element, e.g., double-sided tape 32, positioned at the end of the straps 30 whereby the straps which have the edges of their layers bonded together can be selectively attached to each other.

Figure 8:
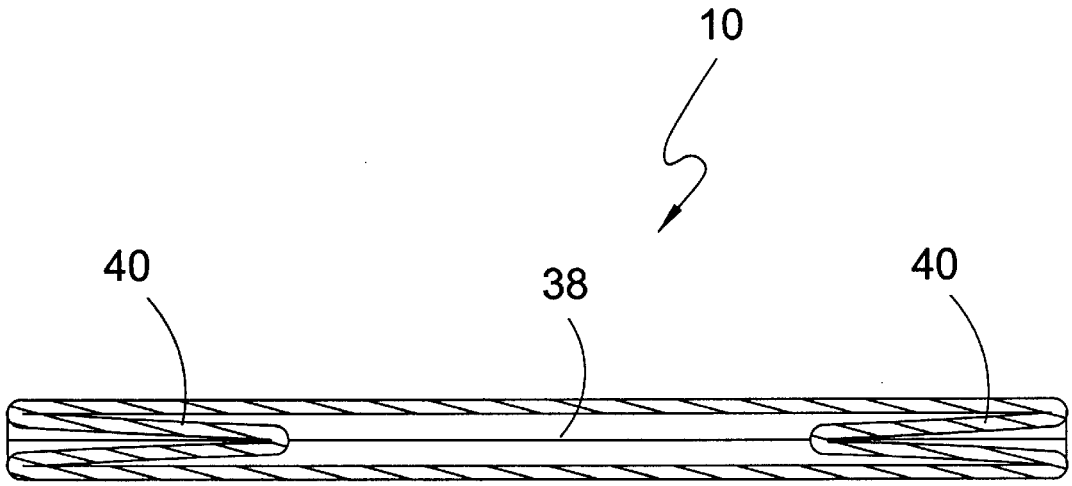
FIG. 8 is a cross sectional view of the present invention.

Turning to FIG. 8, shown therein is a cross sectional view of the present invention 10. Shown is a cross sectional view taken from FIG. 6 as indicated showing the pleat 40 that creates a large cavity 38 when the convertible cape is expanded by separating the multi-layers at the perforation.

Figure 9:
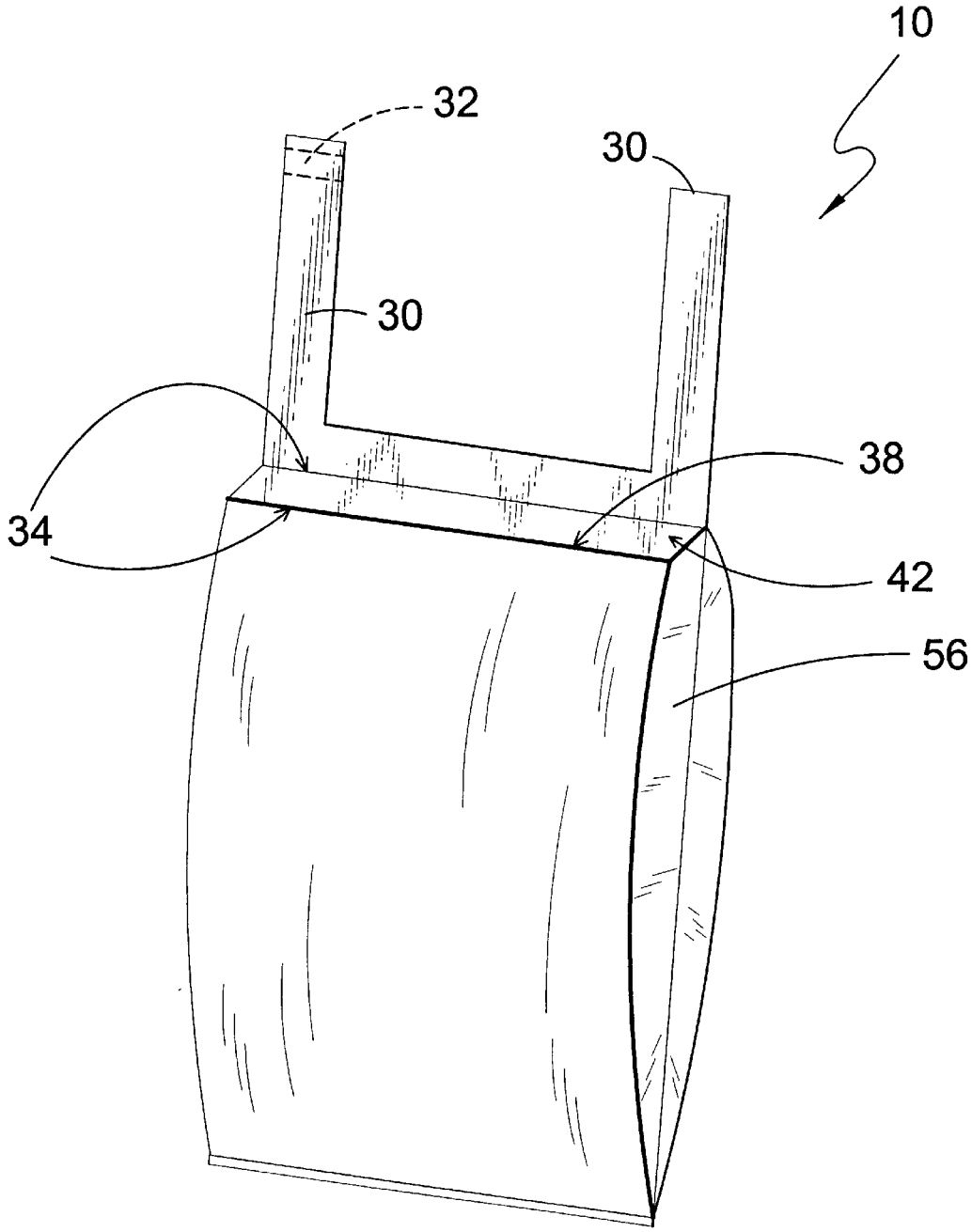
FIG. 9 is a perspective view of the present invention in an expanded form.

Turning to FIG. 9, shown therein is a perspective view of the present invention 10 in an expanded form having a pair of side walls 56 that is needed for certain types of hair care treatment such as loop rod perms. Shown are the straps 30 and double-sided tape 32 along with the separated perforation 34 line which provides an opening 42 for entry into the inner cavity 38 which is defined by the front and rear layers, the sides and the perforation 34.

Figure 10:
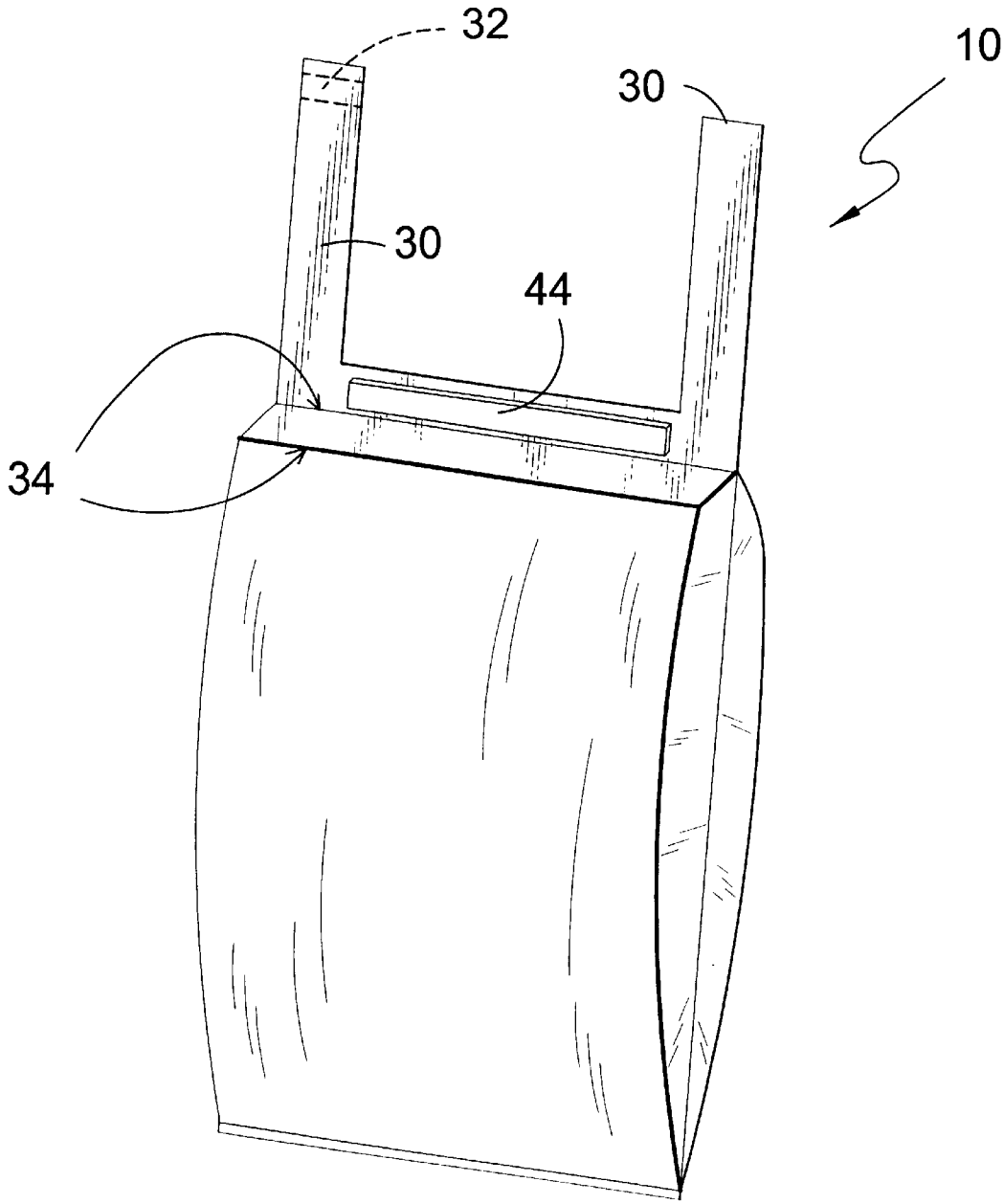
FIG. 10 is a perspective view of the present invention in an expanded form.

Turning to FIG. 10, shown therein is a perspective view of the present invention 10 in an expanded form having a piece of material 44 fixed between the straps 30 and above perforation 34 and below the neck opening which can serve as a soft collar and an absorbent material to absorb any fluids dripping down the neck of the user. The double-sided tape 32 is also shown.

Figure 11:
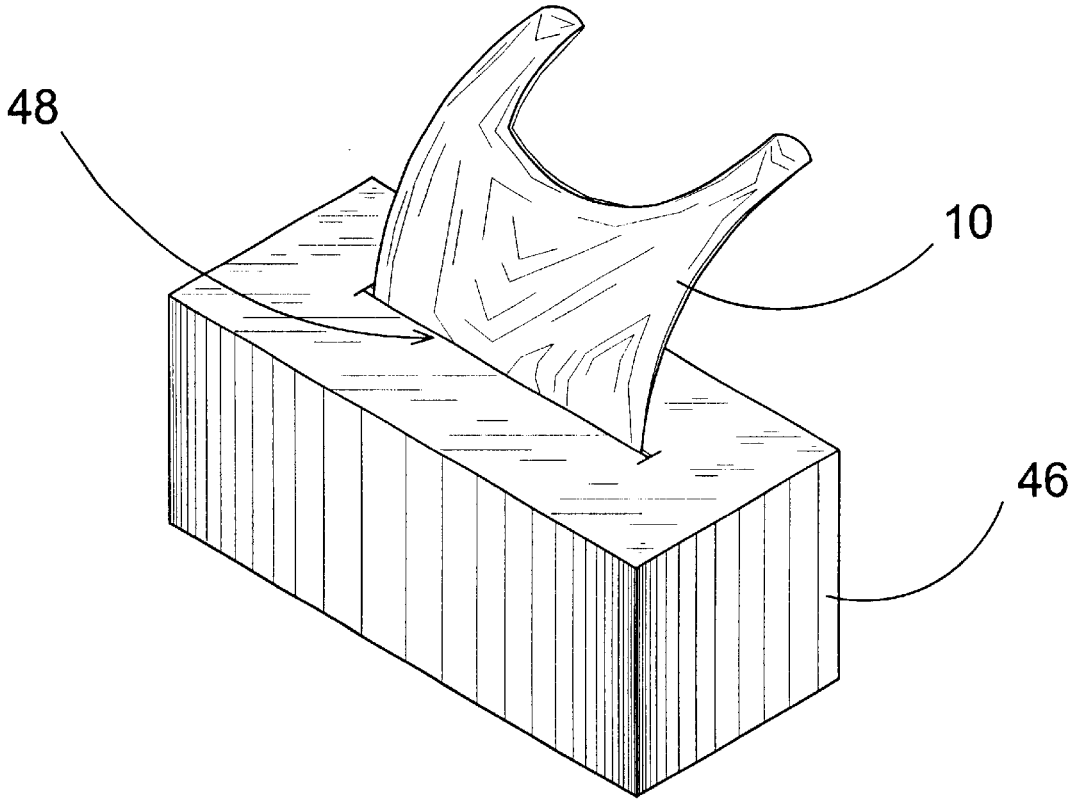
FIG. 11 is a perspective view of the present invention provided within a box dispenser.

Turning to FIG. 11, shown therein is a perspective view of the present invention 10 provided within a box dispenser 46. Shown is the convertible cape of the present invention 10 having a dispenser 46 whereupon the capes are folded in such a manner that removal of one will cause the next to extend from the dispenser aperture 48 ready for removal.

Figure 12:
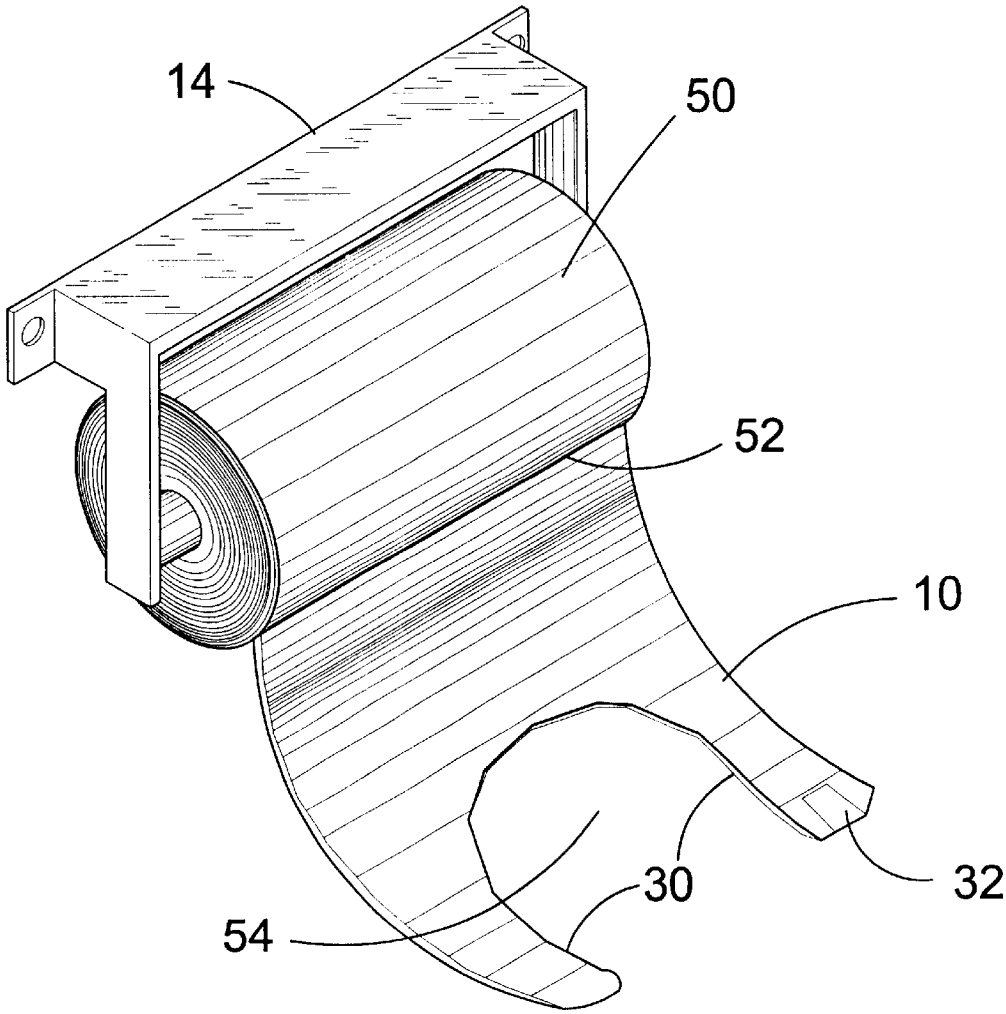
FIG. 12 is a perspective view of the present invention wound as a roll mounted to a dispenser.

Turning to FIG. 12, shown therein is a perspective view of the present invention 10 wound as a roll 50 mounted to a wall or like dispenser 14. Shown is the convertible cape of the present invention having a roll dispenser whereupon the capes are attached to each other having a second end perforation 52 on its end whereby a cape can be removed from the roll by detachment along the lines of perforation 52. Shown also are the straps 30, a U-shaped neck opening 54 between the straps, and double-sided tape 32.

What is claimed to be new and desired to be protected by Letters Patent is set forth in the appended claims:

I claim:

1. An apparatus for use as a protective covering for the hair on the head and the body of a user during a hair treatment procedure, comprising:

a) a front layer and a rear layer, said front and rear layers having a top, a bottom, and a pair of sides, said front and rear layers being generally rectangular, said top having a U-shaped neck opening therein;

b) a pair of straps disposed on said top of said front and rear layers, wherein one strap is disposed on each of said sides;

c) wherein said U-shaped neck opening is disposed between said straps;

d) means for a fastener disposed on at least one of said straps whereby said straps can be fastened to each other to permit the apparatus to be attached to the neck of the user;

e) means for bonding the edges of said front and rear layers whereby the edges of said front and rear layers, said straps and said U-shaped neck opening are bonded together having a cavity formed therein, said neck opening having a lower edge;

f) said cavity defined by said front and rear layers and a perforation on said front layer, said cavity having a top portion and a lower portion; and, g) a means for perforating said front layer disposed between said top portion of said cavity and said lower edge of said U-shaped neck opening whereby separation of the perforation will permit entry into said cavity.

2. The apparatus of claim 1, wherein the apparatus is made of impermeable material.

3. The apparatus of claim 2, wherein the apparatus is made of plastic material.

4. The apparatus of claim 3, wherein said means for a fastener comprises double-sided tape.

5. The apparatus of claim 4, wherein said means for bonding comprises a heated bond.

6. The apparatus of claim 5, wherein said means for perforating comprises an aligned series of discrete spaced perforate openings.

7. The apparatus of claim 6, wherein said pair of sides comprise pleated material.

8. The apparatus of claim 7, wherein said perforate openings are disposed to permit said cavity to have a maximum size.

9. The apparatus of claim 8, further comprising a collar member disposed on said front layer below said lower edge of said U-shaped neck opening to permit placement around the neck of a user.

10. The apparatus of claim 9, further comprising means for connecting successive front and rear layers whereby the front and rear layers will roll off of a dispenser.

11. The apparatus of claim 10, wherein said means for connecting comprises a perforation disposed between successive front and rear layers.

* * * * *